US010131530B2

(12) United States Patent
Trettin

(10) Patent No.: US 10,131,530 B2
(45) Date of Patent: Nov. 20, 2018

(54) LIQUID DISPENSER WITH VALVE

(71) Applicant: DAVID S. SMITH AMERICA, INC., Lester Prairie, MN (US)

(72) Inventor: Bradley L. Trettin, Buffalo Lake, MN (US)

(73) Assignee: DAVID S. SMITH AMERICA, INC., Lester Prairie, MN (US)

( * ) Notice: Subject to any disclaimer, the term of this patent is extended or adjusted under 35 U.S.C. 154(b) by 35 days.

(21) Appl. No.: 15/313,296

(22) PCT Filed: May 21, 2015

(86) PCT No.: PCT/US2015/031926
§ 371 (c)(1),
(2) Date: Nov. 22, 2016

(87) PCT Pub. No.: WO2015/179614
PCT Pub. Date: Nov. 26, 2015

(65) Prior Publication Data
US 2017/0190562 A1 Jul. 6, 2017

Related U.S. Application Data

(63) Continuation-in-part of application No. 29/491,758, filed on May 23, 2014, now Pat. No. Des. 766,083.
(Continued)

(51) Int. Cl.
*B65D 47/08* (2006.01)
*B67D 3/04* (2006.01)
(Continued)

(52) U.S. Cl.
CPC ..... *B67D 3/045* (2013.01); *B65D 47/248* (2013.01); *B65D 51/18* (2013.01);
(Continued)

(58) Field of Classification Search
CPC ..... B67D 3/045; B65D 47/06; B65D 47/28; B65D 2101/0015
(Continued)

(56) References Cited

U.S. PATENT DOCUMENTS 855,517 A * 6/1907 Lippy ..... F16K 1/42 251/333
866,906 A * 9/1907 Berry ..... F16K 1/42 251/333
(Continued)

FOREIGN PATENT DOCUMENTS

CN 104528135 A 4/2015
EP 0213783 A1 3/1987
(Continued)

*Primary Examiner* — Patrick M Buechner
*Assistant Examiner* — Michael J Melaragno
(74) *Attorney, Agent, or Firm* — Vidas Arrett & Steinkraus

(57) ABSTRACT

A fluid dispenser has a main body, a valve member, and a dome member. The dome member is attached to the valve member such that the valve member is slidable within the main body. Pressing on the dome member opens the valve so that fluid can flow out of a dispensing port in the main body. The main body has an outer flow surface and an inner flow surface. The valve has a face. In conjunction, the outer flow surface, inner flow surface, and face define a fluid passageway for fluid to flow exteriorly to the inner flow surface, interiorly to the outer flow surface, and exit the fluid dispenser via the dispensing port.

19 Claims, 17 Drawing Sheets

Related U.S. Application Data

(60) Provisional application No. 62/002,377, filed on May 23, 2014.

(51) Int. Cl.
*B65D 47/24* (2006.01)
*B65D 51/18* (2006.01)

(52) U.S. Cl.
CPC ..... *B65D 2101/0023* (2013.01); *B65D 2251/0031* (2013.01); *B65D 2251/0087* (2013.01)

(58) Field of Classification Search
USPC ..... 222/153.06, 501, 511, 518, 206–216; 251/342, 320, 339, 318, 319, 321, 328, 251/333
See application file for complete search history.

(56) References Cited

U.S. PATENT DOCUMENTS 1,818,856 A * 8/1931 Langdon ..... F16K 21/04 251/210
1,884,442 A * 10/1932 Wells ..... F16K 25/04 251/210
2,114,789 A * 4/1938 Urquhart ..... F16K 1/443 137/246.16
2,713,988 A * 7/1955 Kitterman ..... F16K 21/04 222/518
2,874,996 A * 2/1959 Zajac ..... F16L 37/22 137/322
2,875,978 A * 3/1959 Kmiecik ..... F16K 1/34 137/469
2,976,010 A * 3/1961 Huthsing, Sr. ..... A62C 13/003 251/321
3,263,875 A 8/1966 Lofdahl
3,443,728 A * 5/1969 Scholle ..... B65D 47/2025 222/511
3,595,445 A 7/1971 Buford
4,286,636 A * 9/1981 Credle ..... B65D 83/0055 141/114
4,440,316 A * 4/1984 Christine ..... B65D 47/248 222/183
4,452,425 A * 6/1984 Lucking ..... F16K 21/04 220/724
4,471,807 A * 9/1984 Lucking ..... B67D 3/043 137/614.12
4,475,566 A * 10/1984 Haines ..... B67B 7/26 137/318
4,477,056 A * 10/1984 Alexius ..... F16K 39/02 251/282
4,687,123 A 8/1987 Hyde
5,000,359 A 3/1991 Scholle et al.
5,447,257 A * 9/1995 Dark ..... B65D 83/48 137/903
6,131,767 A 10/2000 Savage et al.
6,401,752 B1 * 6/2002 Blackbourn ..... B67D 3/044 137/588
6,435,382 B1 * 8/2002 Giblin ..... B65D 1/40 222/509
6,470,910 B2 10/2002 Blackbourn et al.
6,631,744 B1 * 10/2003 Gerhart ..... B65D 1/18 141/22
6,896,158 B2 * 5/2005 Leray ..... B65D 81/3283 222/145.1
7,140,520 B1 * 11/2006 Rutler ..... B67D 3/043 222/511
7,513,395 B2 * 4/2009 Labinski ..... B67D 3/044 137/588
7,726,525 B2 6/2010 Nini
8,113,239 B2 * 2/2012 Richards ..... B67D 3/044 137/587
8,336,743 B2 12/2012 Bellmore
8,517,229 B2 8/2013 Nini
8,584,909 B2 * 11/2013 Totten ..... B67D 3/043 222/509
8,602,387 B2 12/2013 Wrigley et al.
2007/0131725 A1 * 6/2007 Friedman ..... B67D 1/14 222/518
2007/0181615 A1 * 8/2007 Allanson ..... B65D 47/248 222/518
2007/0290010 A1 * 12/2007 Nini ..... B67D 3/044 222/511
2008/0078970 A1 * 4/2008 Craft ..... F16K 15/18 251/144
2008/0237273 A1 * 10/2008 Smith ..... B67D 3/045 222/509
2008/0237274 A1 * 10/2008 Lester ..... B67D 3/045 222/518
2008/0237275 A1 * 10/2008 Lester ..... B67D 3/043 222/518
2008/0237276 A1 * 10/2008 Lester ..... B67D 3/043 222/518
2011/0017782 A1 * 1/2011 Nini ..... B67D 3/0045 222/518
2015/0069094 A1 * 3/2015 Maher ..... B65D 11/22 222/511
2016/0304332 A1 * 10/2016 Georgelos ..... B32B 27/18
2017/0190562 A1 * 7/2017 Trettin ..... B67D 3/045

FOREIGN PATENT DOCUMENTS

EP 0432070 A1 6/1991
GB 2101275 A 1/1983
GB 2140132 A 11/1984
GB 2169061 A 7/1986
WO 1997048614 A1 12/1997

* cited by examiner

LIQUID DISPENSER WITH VALVE

CROSS-REFERENCE TO RELATED APPLICATIONS

This Application claims the benefit of and priority to U.S. Provisional Application No. 62/002,377, filed May 23, 2014, the entire contents of which are herein incorporated by reference.

This Application further claims the benefit of and priority to U.S. Design Application titled "Fluid Dispenser", having application Ser. No. 29/491,758, filed May 23, 2014; the contents of which are herein incorporated by reference.

STATEMENT REGARDING FEDERALLY SPONSORED RESEARCH

Not Applicable.

BACKGROUND OF THE INVENTION

Heretofore, various types of fluid dispensers have been developed to dispense fluid from various types of containers. Known types of fluid dispensers can suffer from a variety of problems: dripping after closure and oxygen transmission through the fluid dispenser and into the container are examples of the problems. Oxygen transmission into the fluid within the container can lead to reduced freshness or taste due to oxidation of the fluid. This phenomenon is particularly acute in the wine industry.

Consequently, there remains a need for a fluid dispenser that has a low oxygen transmission rate and does not drip after closure.

Without limiting the scope of the invention a brief summary of some of the claimed embodiments of the invention is set forth below. Additional details of the summarized embodiments of the invention and/or additional embodiments of the invention may be found in the Detailed Description of the Invention, below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a fluid dispenser has a flow configuration and a sealed configuration. The fluid dispenser comprises a main body, a dome member, and a valve member. The main body has an outer flow surface and an inner flow surface, and the outer flow surface has an opening therethrough defining a dispensing port. The valve member has a face and is coupled to the dome member. When the fluid dispenser is in the flow configuration, the outer flow surface, inner flow surface, and face define a fluid passageway for fluid to flow exteriorly to the inner flow surface, interiorly to the outer flow surface, and exit the fluid dispenser via the dispensing port.

In some embodiments, a fluid dispenser comprises a main body and a valve member. The main body has a seal and a sidewall with a first opening therein. The valve member is sildable within the main body and has an open position and a closed position. The valve member further has a channel therein; the channel has a first sidewall and a second sidewall opposite the first sidewall. When the valve member is in the closed position, the seal extends into the channel and contacts the first and second sidewalls. The main body and valve member define a second opening and flow passage therebetween. When the valve member is in the open position, the flow passage extends from the first opening to the second opening and when the valve portion is in the closed position, the flow passage is sealed by contact between the seal and at least the first sidewall.

In some embodiments, a fluid dispenser comprises a main body, an elastomeric dome member, and a movable valve member. The main body has a sidewall with an opening therein through which fluid can be dispensed. The valve member is movable between a sealed position and an open position. The valve member has a stem which is coupled to the elastomeric dome member. The stem has a longitudinal axis. In the open position the main body and valve member define a flow passage which ends at the opening. The flow passage includes a section which extends 360 degrees about the stem and is bounded by the main body and the valve member. The flow passage is a slanted passage which slants relative to the longitudinal axis of the stem.

DETAILED DESCRIPTION OF THE INVENTION

In some embodiments, a fluid dispenser comprises a main body, a valve member and a dome member. The valve member is coupled to the dome member and is movable within the main body such that upon depression of the dome member, fluid can flow out of the fluid dispenser.

Figure 1:
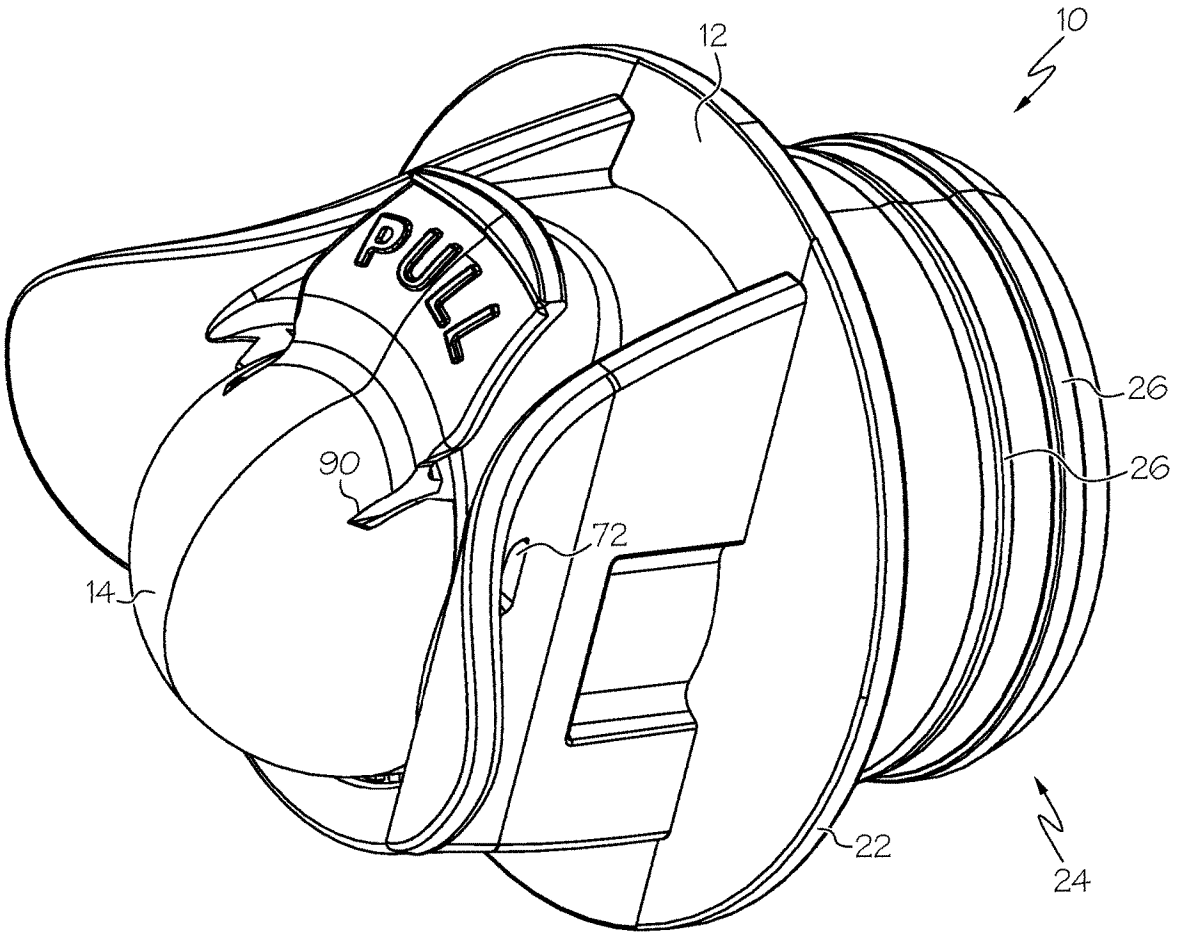
FIG. 1 shows a 3-dimensional view of an example of a fluid dispenser.
Figure 2:
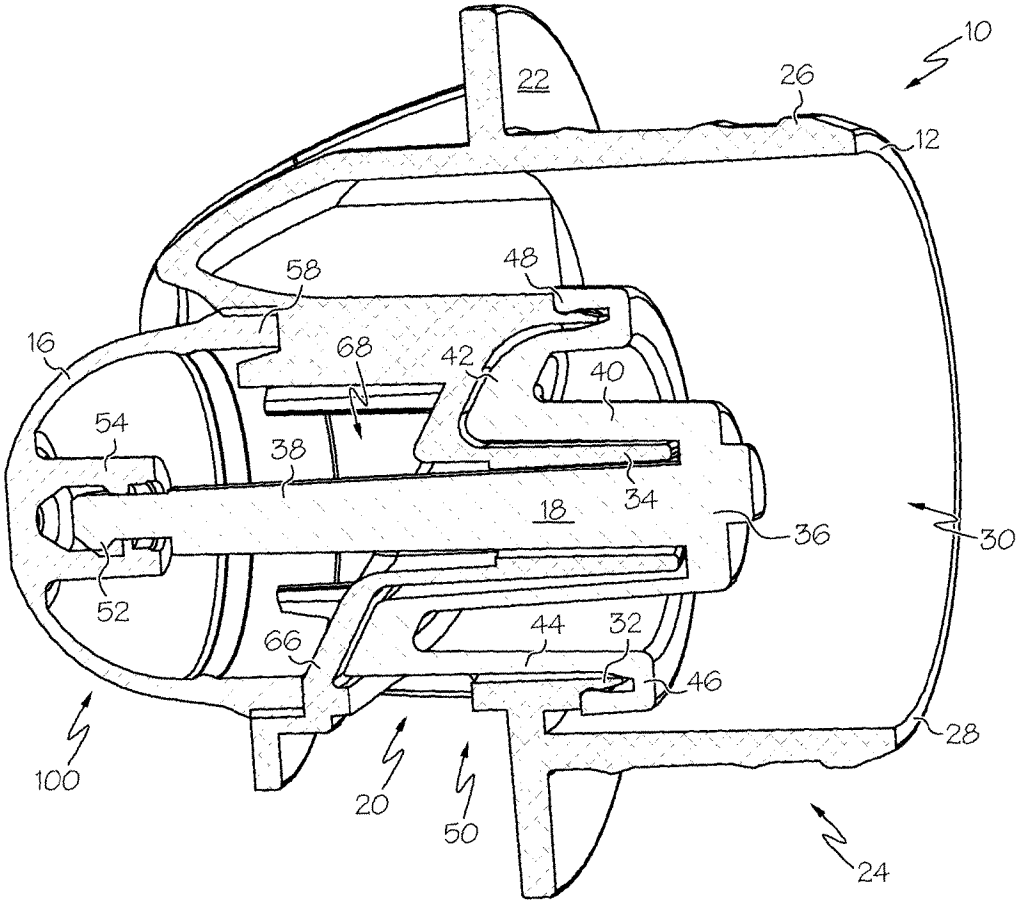
FIG. 2 shows a cutaway view of the fluid dispenser of FIG. 1.

With regard to FIG. 1, the main body 12 of the fluid dispenser 10 is shown with a cap 14 attached thereto. In some embodiments, the cap 14 protects the dome member 16 (FIG. 2) and, prior to removal of the cap 14, shows evidence of tampering. As shown in FIG. 2, which is a cross-sectional view, the dome member 16 is coupled to a valve member 18. The valve member 18 is slidable within the main body 12 such that when the dome member 16 is pressed, fluid can flow out of a dispensing port 20.

In some embodiments, the main body 12 has a flange 22 and a coupler 24. The coupler 24 is configured to attach the main body 12 to a container (not shown) in order to dispense fluid from the container via the fluid dispenser 10. In some embodiments, the coupler 24 has one or more ribs or beads 26 extending radially outwardly in order to provide a seal between the outlet (e.g., spout) of the container and the coupler 24. As shown, the beads 26 are provided on the outside of the coupler 24 such that the coupler 24 can be inserted into a female connection on the container. Other configurations are also contemplated, however. For example, the beads 26 can be disposed on the inside of the coupler 24. Further, the coupler 24 can have interior and/or exterior threads or any other suitable attachment or sealing mechanism. The coupler 24 can also be attached to a screw ring which can be attached to the container (not shown). In some embodiments, the coupler 24 includes three beads 26; however, any suitable number can be employed, for example 1, 2, 3, 4, 5, 6, 7 or more. Additionally, where multiple beads 26 are used, the beads 26 can be spaced apart from one another and spaced from the flange 22 and coupler end 28 (FIG. 2) in any suitable arrangement.

As further shown in FIG. 2, the main body 12 defines a cavity 30 which is partially bounded by the coupler 24. Further, in some embodiments, the main body 12 comprises a seal 32 that extends into the cavity 30. In some embodiments, the main body 12 comprises a guide 34 through which a portion of the valve member 18 extends.

Figure 10:
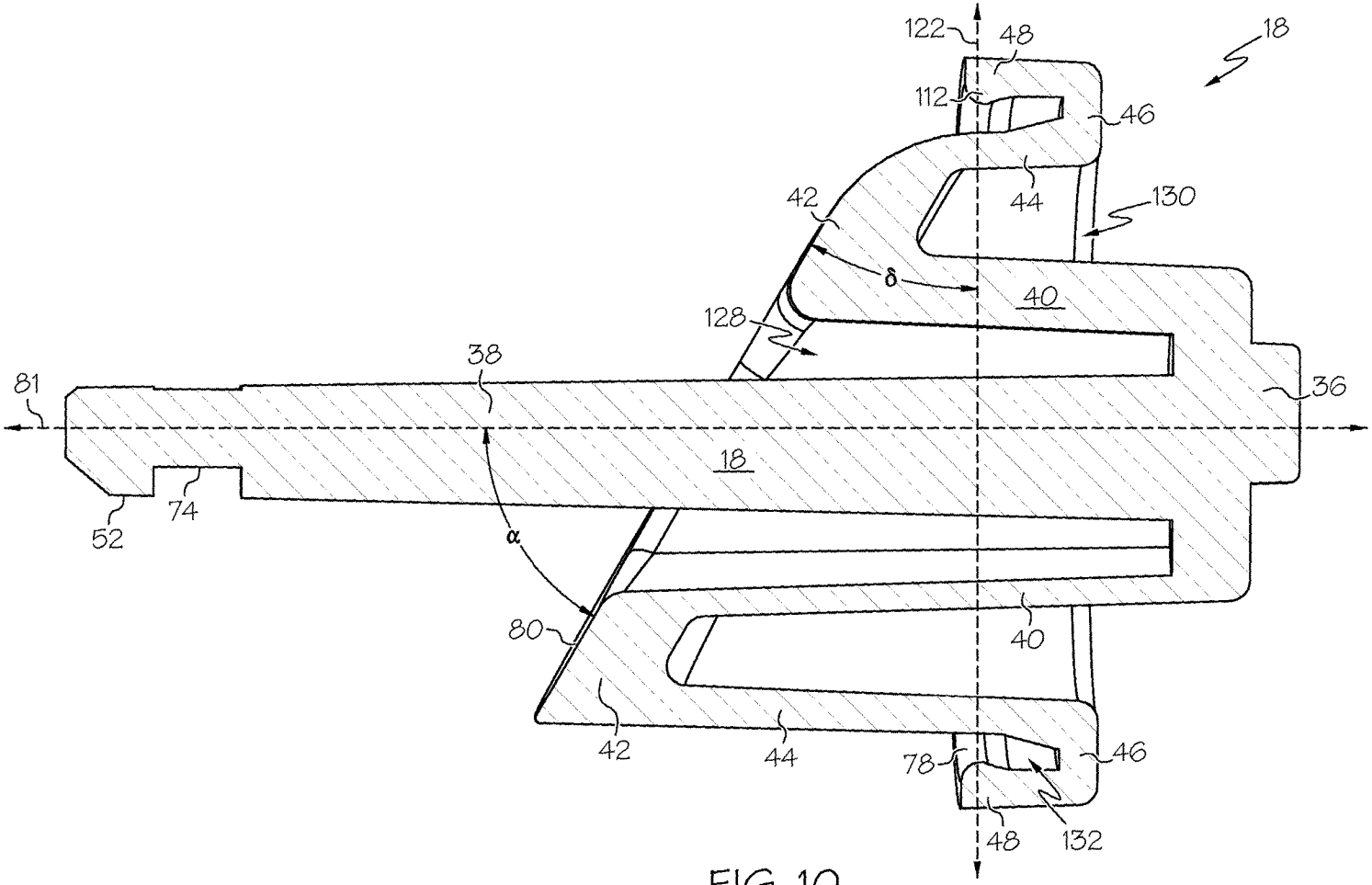
FIG. 10 shows a cutaway view of the valve member of FIGS. 8 and 9.

In some embodiments, the valve member 18 comprises a base portion 36, a stem 38 extending from the base portion 36, an inner tubular portion 40, an inner facing wall 42, and intermediate tubular portion 44, an outer facing wall 46, and an outer tubular portion 48. In some embodiments, the length of the intermediate tubular portion 44 varies around the periphery of the valve member 18. For example, in some embodiments, the intermediate tubular portion 44 is longer at the bottom of the valve member 18 than at the top of the valve member 18, as shown in FIGS. 2 and 10. In some embodiments, the length of the inner tubular portion 40 varies around the periphery of the valve member 18; for example, the length of the inner tubular portion 40 may be longer at the bottom of the valve member 18 than at the top of the valve member 18, as further shown in FIGS. 2 and 10. In some embodiments, the length of the intermediate tubular portion 44 is longer closer to the dispensing port 20 (FIG. 2) than further away from the dispensing port 20.

As shown in FIG. 2, the outer tubular portion 48 contacts the seal 32 of the main body 12 when the fluid dispenser 10 is in a sealed configuration 50, wherein fluid is prevented from flowing out of the fluid dispenser 10.

In some embodiments, a first channel 128 (FIG. 10) is formed between at least a portion of the stem 38 and at least a portion of the inner tubular portion 40. In some embodiments, a second channel 130 is formed between at least a portion of the inner tubular portion 40 and at least a portion of the intermediate tubular portion 44; the second channel may be further bounded by the inner facing wall 42. In some embodiments, a third channel 132 is formed between at least a portion of the intermediate tubular portion 44 and at least a portion of the outer tubular portion 48; the third channel may be further bounded by the outer facing wall 46, as shown for example in FIG. 10. In at least some embodiments, the first and third channels 128, 132 open in a direction opposing the second channel 130.

Although shown in FIGS. 2 and 10 with the valve member 18 having a third channel into which the seal 32 extends, it will be appreciated that the relationship can be reversed such that the main body 12 comprises a channel into which a portion of the valve member 18 extends.

In some embodiments, the valve member 18 further comprises a keeper 52 at the distal end portion of the stem 38. The keeper 52 interfaces with a retainer 54 of the dome member 16. The keeper 52 couples the valve member 18 to the dome member 16 such that the valve member 18 and dome member 16 move in tandem.

Figure 3:
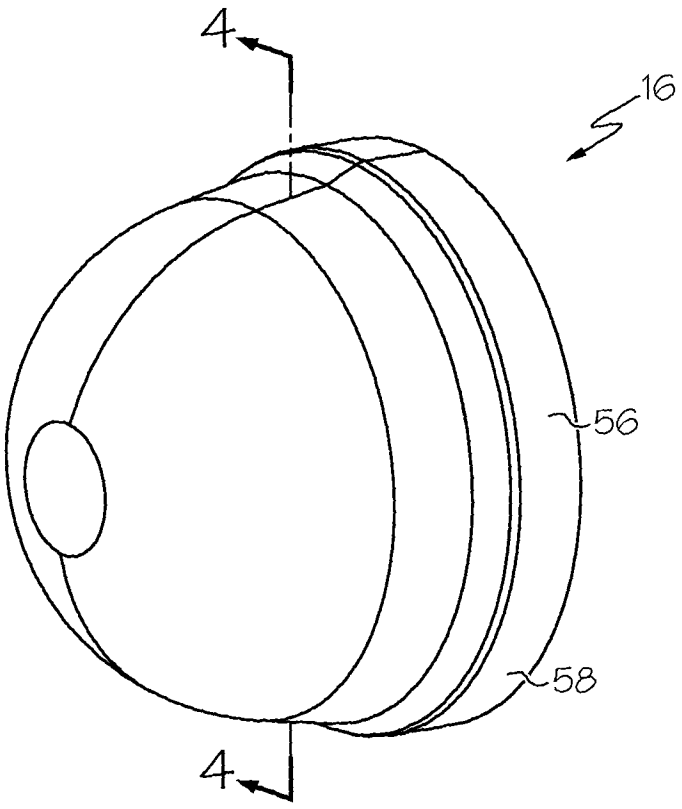
FIG. 3 shows a 3-dimensional view of an example of a dome member.
Figure 4:
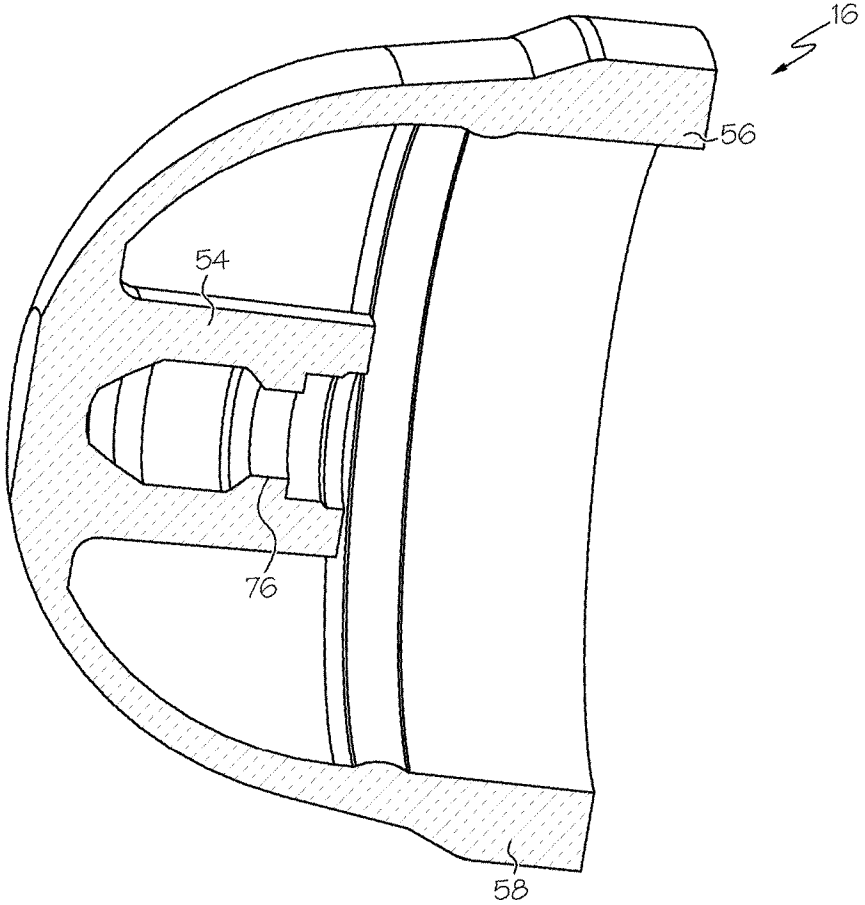
FIG. 4 shows a cutaway view of the dome member of FIG. 3.
Figure 7:
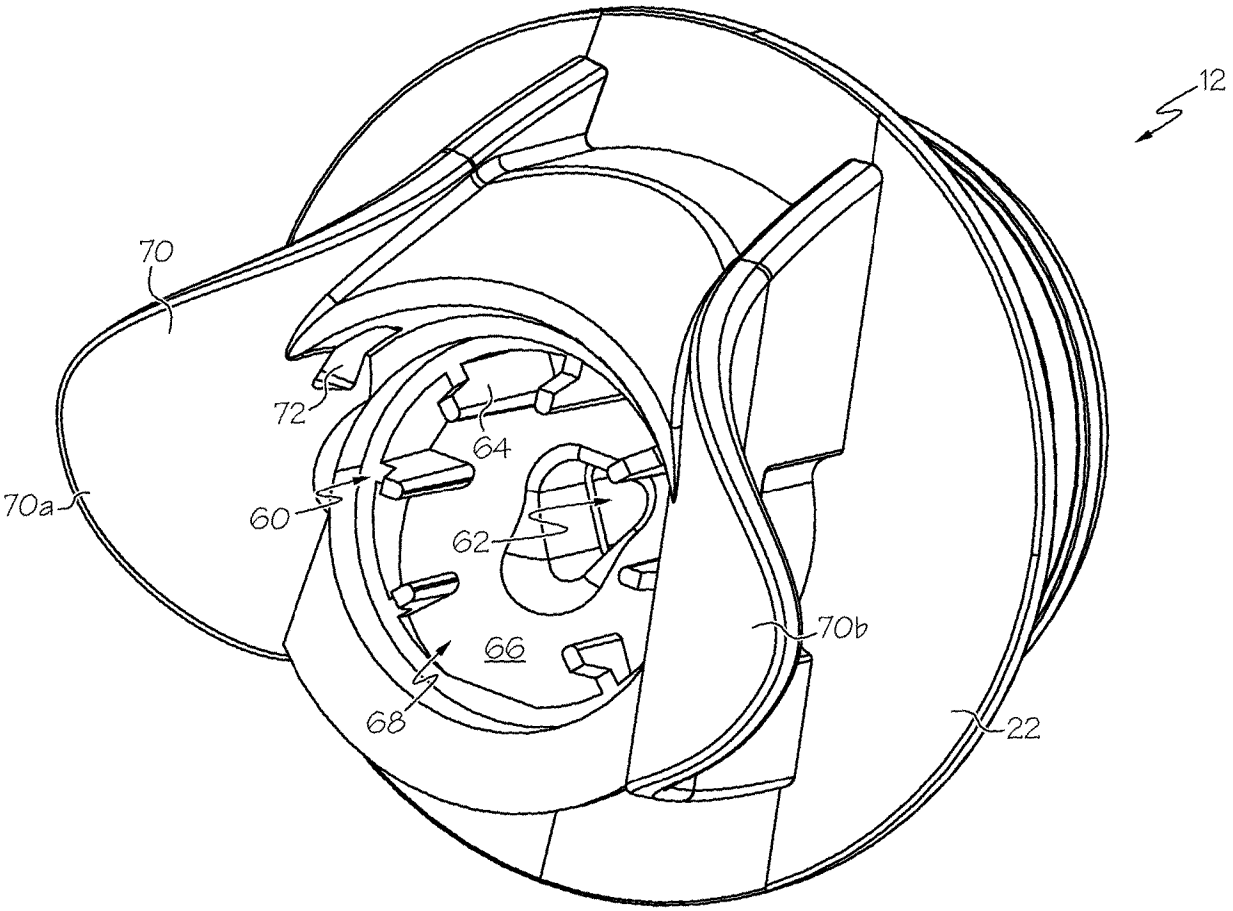
FIG. 7 shows a 3-dimensional view of the front of a main body of the fluid dispenser of FIG. 2.

With regard to FIGS. 3 and 4, the dome member 16 is shown therein in greater detail. In FIG. 4, the dome member 16 is shown in cross-section. The dome member 16 has a base 56. In some examples, as shown in FIGS. 3 and 4, the base 56 is circular. Other shapes and configurations are also contemplated, however; for example, the base 56 can also be square, rectangular, hexagonal, octagonal, or in the shape of any other suitable polygon. In some embodiments, the cross-section of material is thicker at the base 56 of the dome member 16 than nearer the peak of the dome member 16. At least some examples of the base 56 have a seat 58, which is configured to be received by the recess 60 (FIGS. 5 and 7).

In at least some examples, the dome member 16 comprises an elastomeric material. The dome member 16 is elastically deformable from a first configuration 100 (FIG. 2), wherein the fluid dispenser 10 is in a sealed configuration 50, to a second configuration 102 (FIG. 13), in which fluid is permitted to flow out of the fluid dispenser 10. The dome member 16 is predisposed to remain in the first configuration 100 unless a force is applied to it to depress the dome member 16. Thus, the dome member 16 pulls the valve member 18 closed, via keeper 52, as long the dome member 16 is not depressed.

Figure 5:
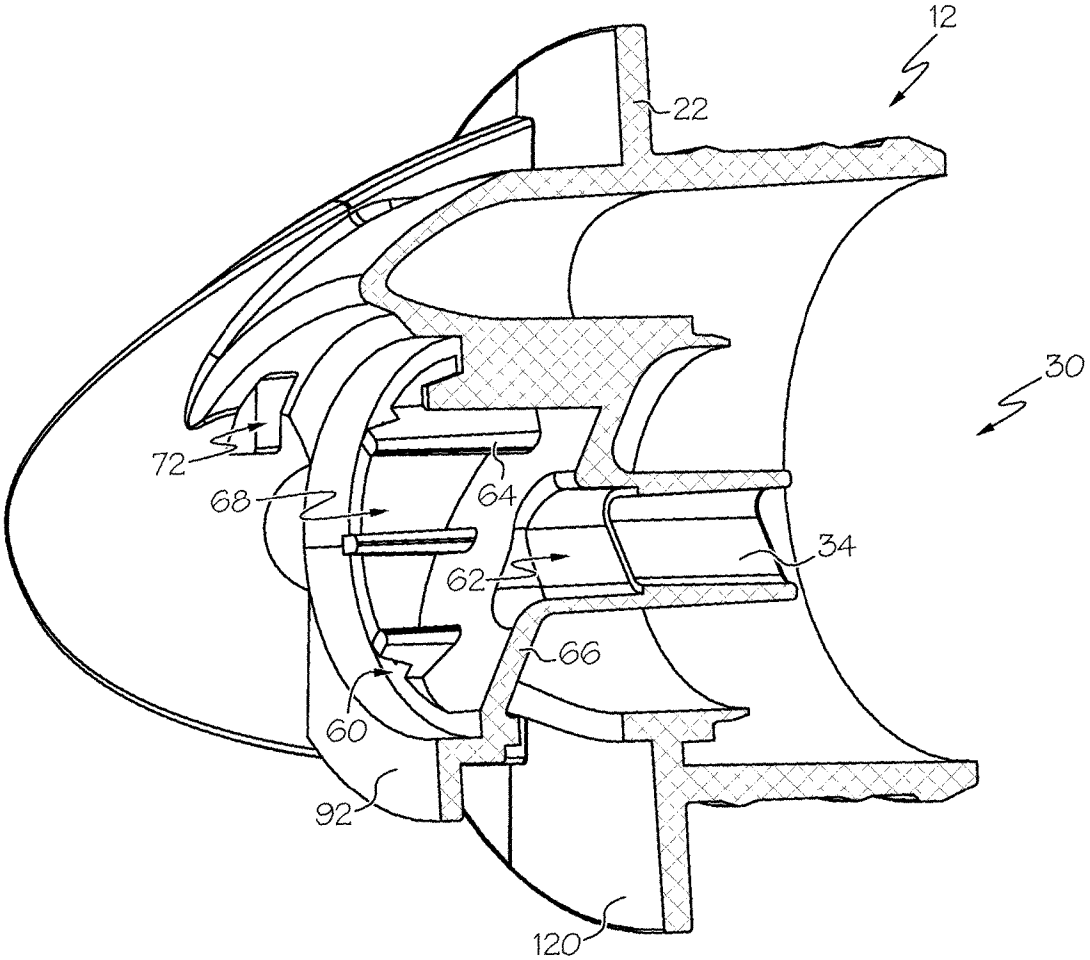
FIG. 5 shows a cutaway view of an example of a main body of the fluid dispenser of FIG. 2.
Figure 8:
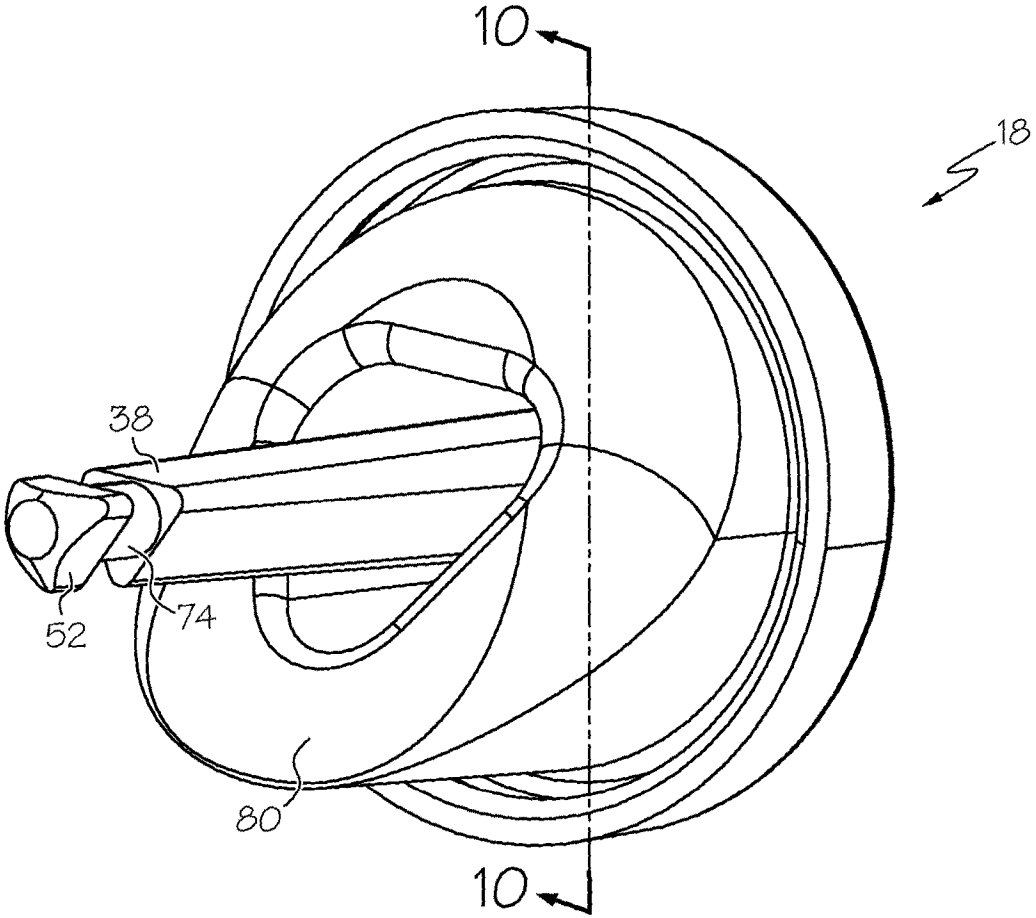
FIG. 8 shows a 3-dimensional view of an example of the valve member.
Figure 9:
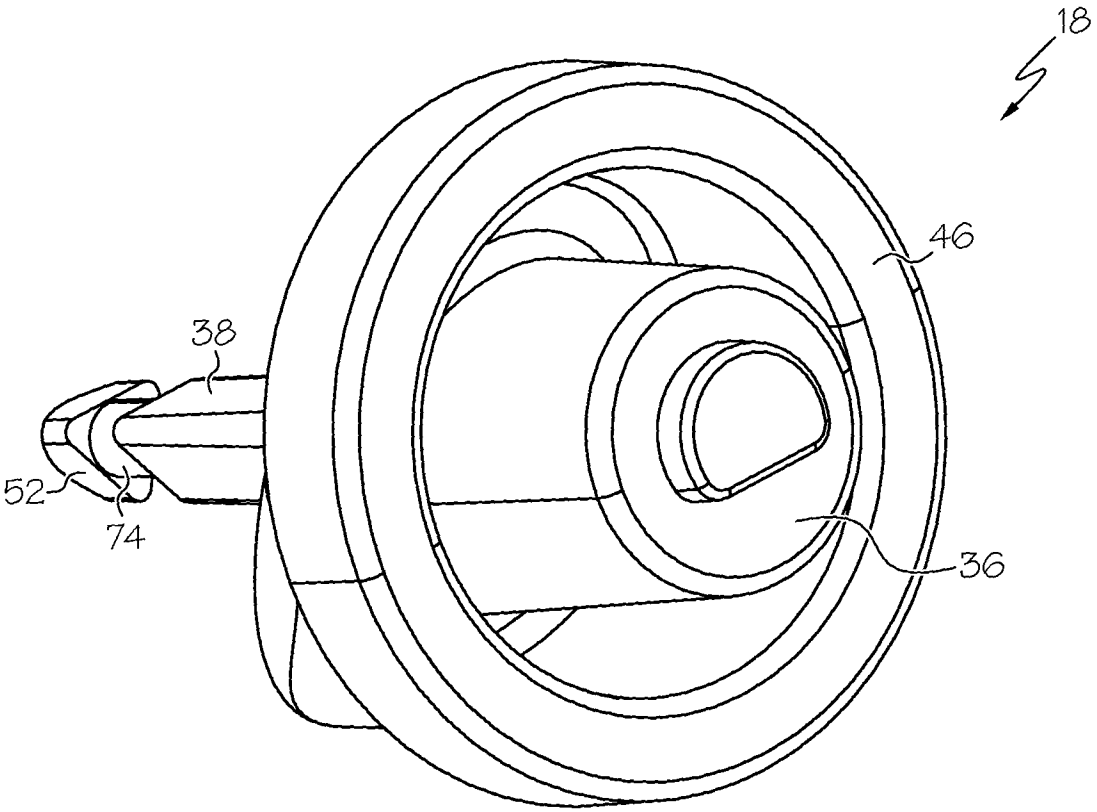
FIG. 9 shows a 3-dimensional view of an example of the valve member of FIG. 8.

Turning to FIG. 5, an example of the main body 12 is shown in the absence of the dome member 16, valve member 18, and cap 14. As shown, the guide 34 defines an opening 62 through which the stem 38 extends (FIG. 2). In some embodiments, the opening 62 is triangular in cross-section. Referring to FIGS. 8 and 9, in some embodiments, the stem 38 has a triangular cross-section to correspond with the triangular cross-section of the guide 34. The guide 34 can have any other suitable cross-sectional shape, for example circular, square, pentagonal, notched.

In some embodiments, the main body 12 comprises one or more stand-off members 64. As illustrated in FIG. 5, for example, a plurality of stand-off members 64 are employed. In some embodiments, the one or more stand-off members 64 are arranged to locate the dome member 16 within the recess 60. In some embodiments, the one or more stand-off members 64 (FIG. 5) abut the seat 58 (FIG. 4) of the dome member 16. Some examples of the main body 12 have at least three stand-off members 64. Some examples of the main body 12 have between three and fifteen stand-off members 64 and some embodiments have seven stand-off members 64, though any suitable number can be employed. Further, in at least some embodiments, the at least one stand-off member 64 is configured as a single stand-off member 64 having an annular shape; a semi-annular shape, for example with a segment cut out of it, can also be used.

Figure 6:
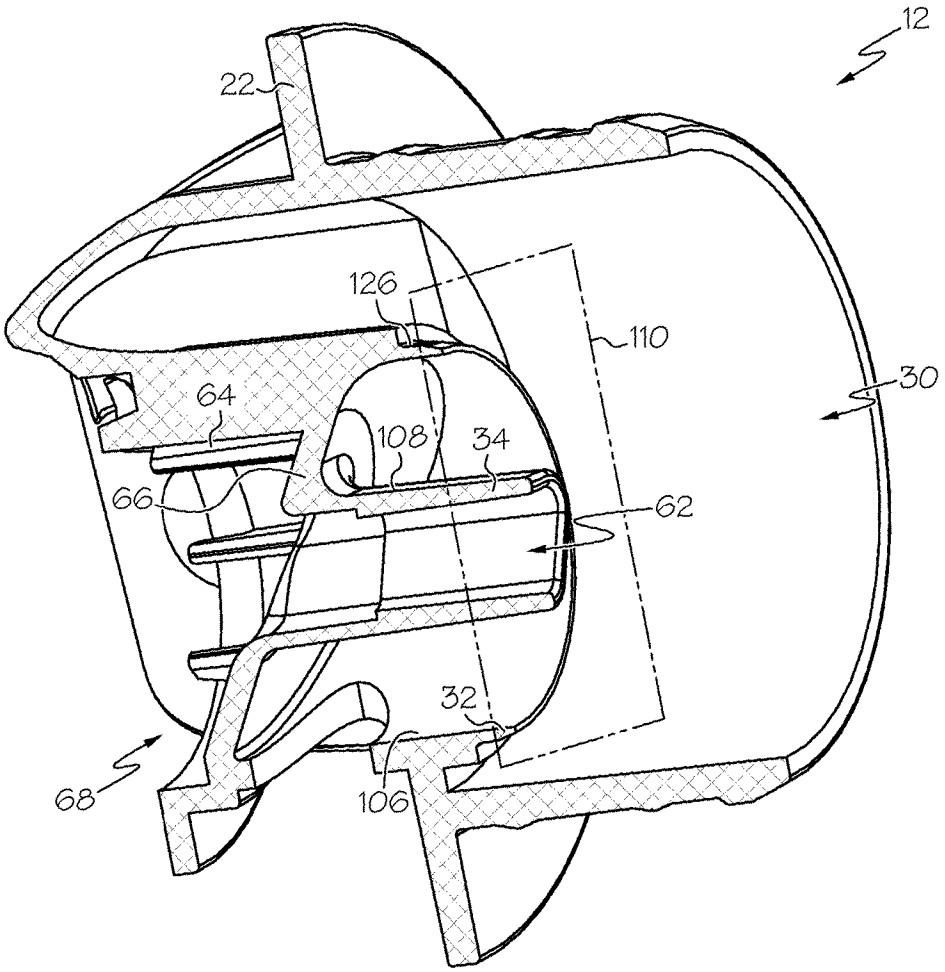
FIG. 6 shows another cutaway view of an example of a main body of the fluid dispenser of FIG. 2.
Figure 13:
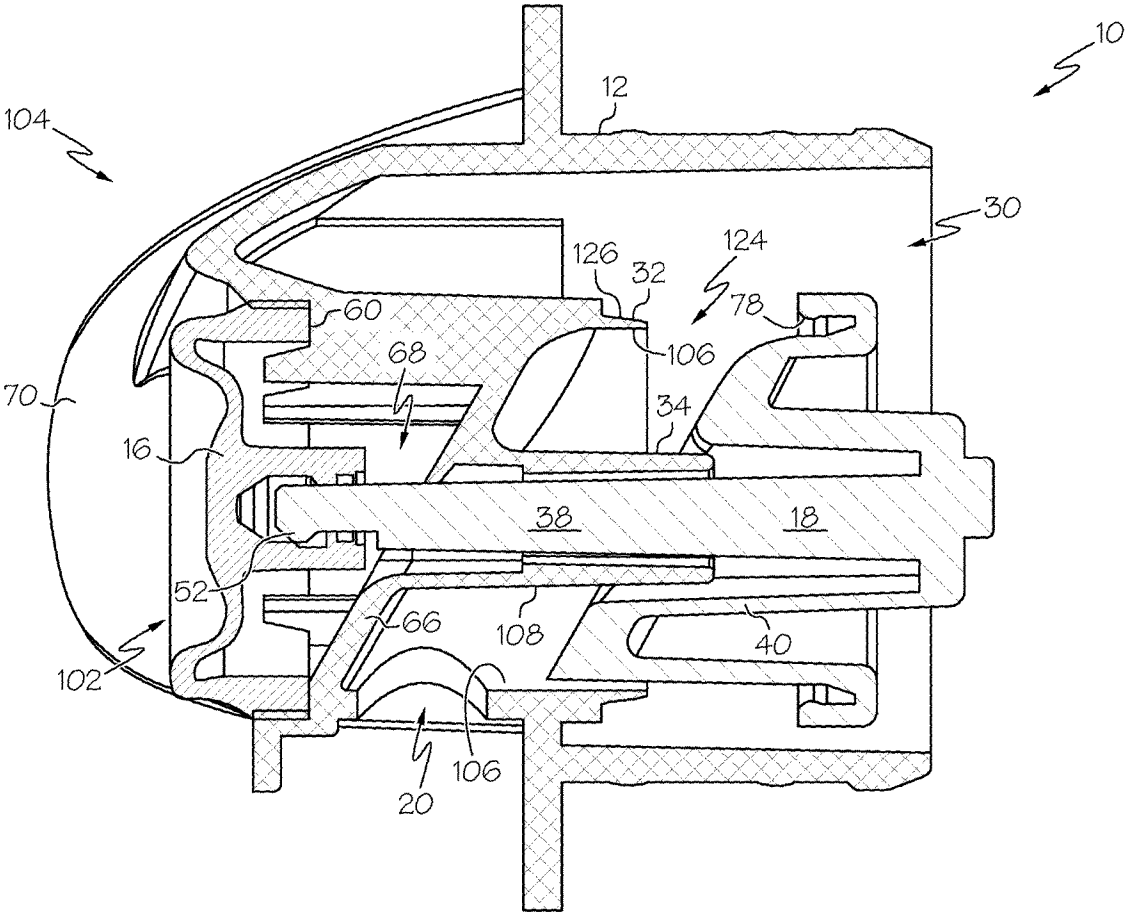
FIG. 13 shows a cutaway view of the fluid dispenser of FIG. 2 in an open or flow configuration.

With further regard to FIGS. 5 and 6, in some examples, the main body 12 has a dividing wall 66, separating the cavity 30 from the chamber 68. In some embodiments, the dividing wall 66 is oriented at a non-zero angle relative to a plane 120 (FIG. 5) defined by the flange 22. In some examples, the main body 12 comprises an outer flow surface 106 and an inner flow surface 108, for example as shown in FIGS. 6 and 13. In at least some examples, the dispensing port 20 forms an opening in the outer flow surface 106.

As shown in FIG. 7, in some embodiments, the main body 12 comprises one or more finger holds 70, for example two finger holds 70, which can be oriented in any suitable orientation. As illustrated, the finger holds 70 are configured such that the user's index finger is placed between one of the finger holds 70, for example 70*a*, and the flange 22 and the user's middle finger is placed between the other of the finger holds, for example 70*b*, and the flange 22. In this way, the user's thumb is used to depress the dome member 16 (FIG. 13) to dispense fluid.

In at least some examples, the main body 12 has one or more detents 72 (FIGS. 1, 5, 7). In some embodiments, the detents 72 retain the cap 14 (FIG. 12) until the cap 14 is removed, as discussed below. Some embodiments of the main body 12 have two opposing detents 72, which can take on any suitable configuration. In some examples, the detents 72 are openings extending through a portion of the respective finger hold 70*a*, 70*b*.

Turning to FIGS. 8-10, the valve member 18 is shown in detail; FIG. 10 is a cross-sectional view of the valve member 18. As illustrated, in some examples, the stem 38 has a generally triangular cross-section, corresponding to the cross-section of the opening 62 of the main body 12 (FIG. 7). Further, in some examples, the keeper 52 is located at a distal end of the stem 38. Just proximal of the keeper 52 is a narrowed portion 74 of the stem 38. The narrowed portion 74 fits into the catch 76 of the dome member 16 (FIG. 4), thereby coupling the dome member 16 and the valve member 18 so that they move in tandem.

The valve member 18 has a sealing surface 78 (FIG. 10) which contacts the seal 32 (FIG. 2) when the fluid dispenser 10 is in the sealed configuration 50. Due to the relatively large area of contact between the sealing surface 78 and the seal 32, the oxygen transmission rate into the fluid can be minimized. This is particularly important in certain industries, for example the wine industry.

With further regard to FIGS. 8 and 10, the valve member 18 has a face 80. In some examples, the face 80 is angled relative to the longitudinal axis 81 of the stem 38. Further, the face 80 is configured to abut, or nearly abut, the dividing wall 66 (FIG. 2) of the main body 12. In some embodiments, the face 80 is angled relative to the longitudinal axis 81 of the stem 38 by an angle $\alpha$, which is less than 90 degrees and, in some examples, is between 45 and 70 degrees. Angle $\alpha$ is measured between the longitudinal axis 81 and the face 80 from a location on the face 80 where the intermediate tubular portion 44 is at its longest (as measured parallel to the longitudinal axis 81 of the stem 38). In some embodiments, the face 80 is angled relative to the valve seal plane 122 (FIG. 10) by a non-zero angle $\delta$. The valve seal plane 122 is defined by a plane extending through the center of the sealing surface 78 along the periphery of the valve member 18. As illustrated in FIG. 10, the valve seal plane 122 extends into and out of the page. In some embodiments, the angle $\delta$ is between 20 and 45 degrees. In at least some embodiments, the longitudinal axis 81 is orthogonal to the valve seal plane 122.

Figure 11:
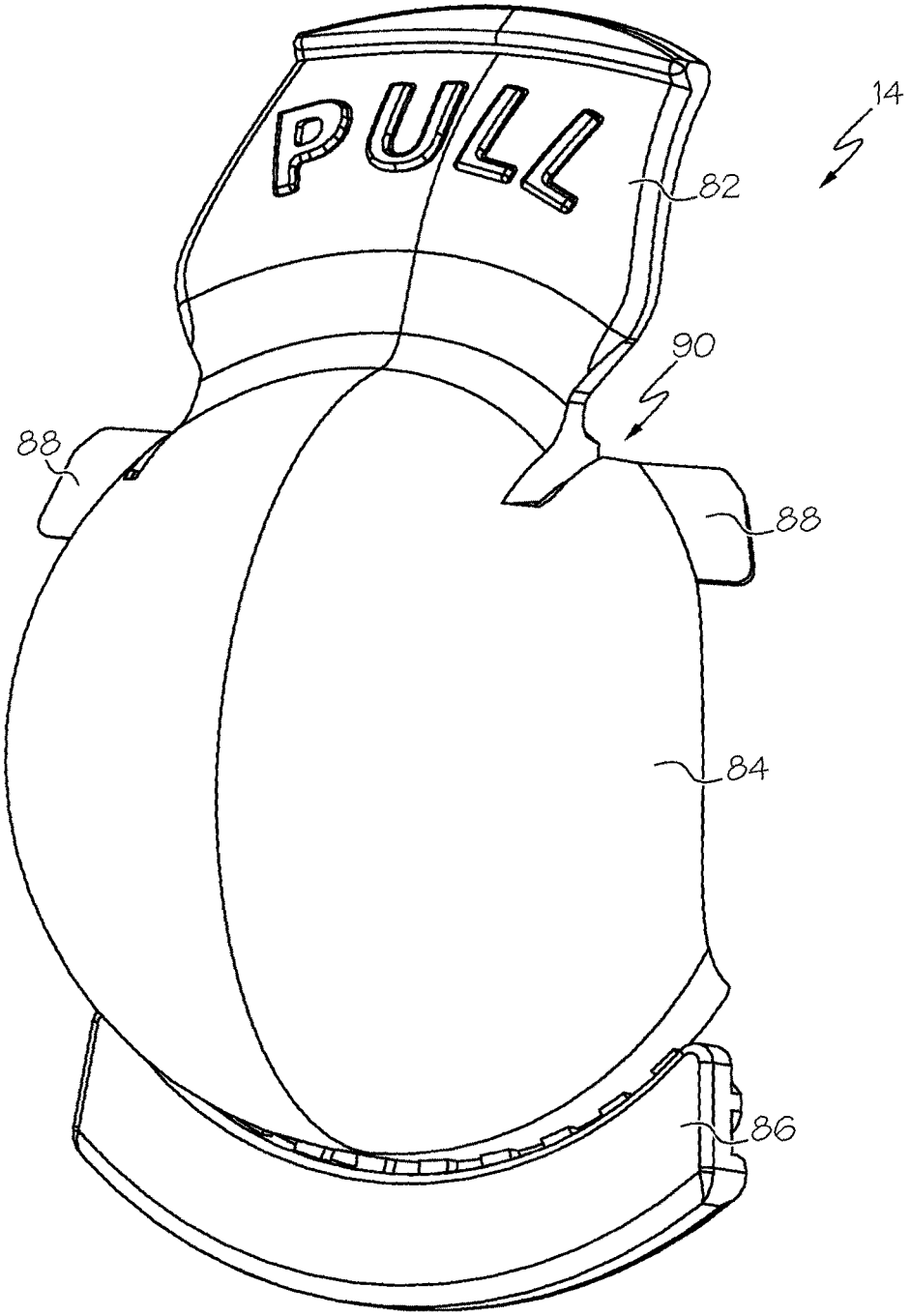
FIG. 11 shows a 3-dimensional view of an example of a cap.
Figure 12:
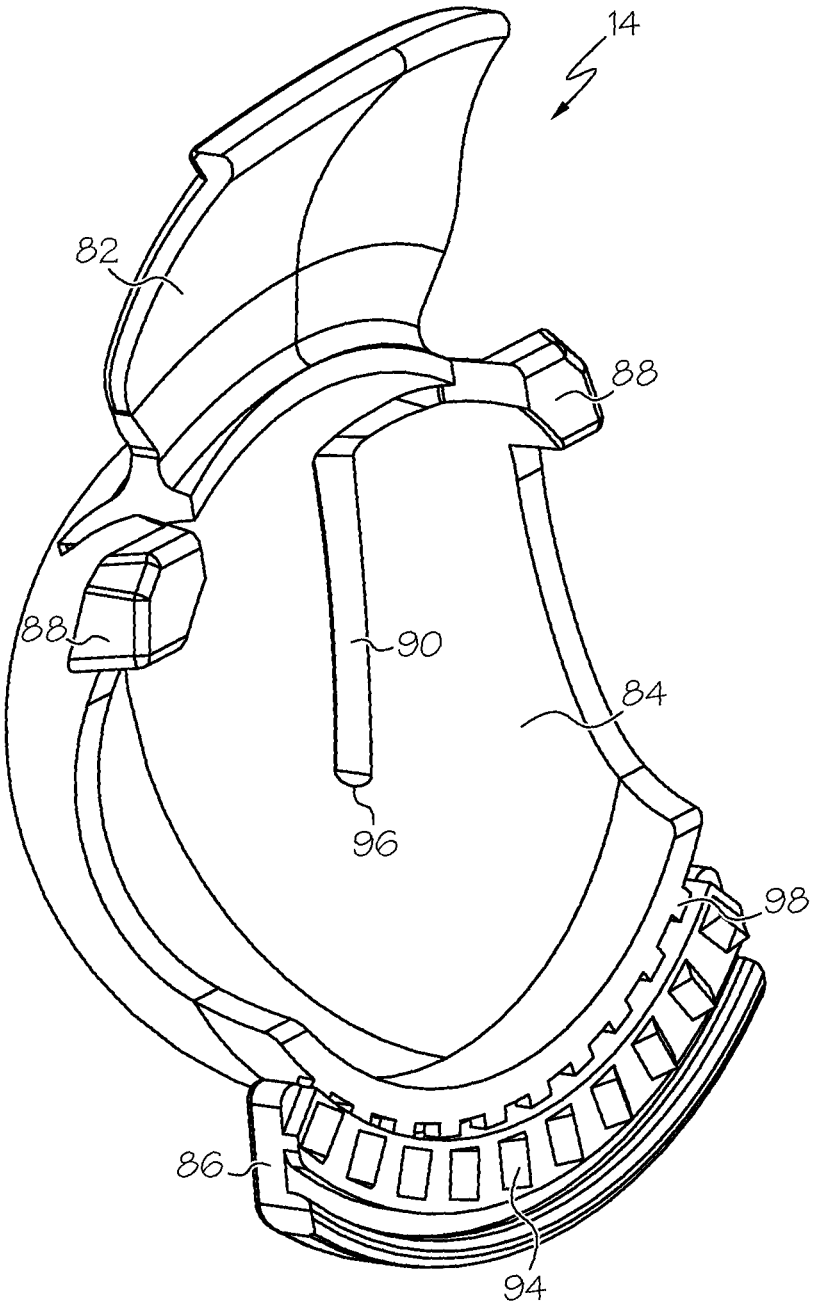
FIG. 12 shows 3-dimensional view of an example of the cap of FIG. 11.

FIGS. 11 and 12 show an example of the cap 14. Some embodiments of the fluid dispenser 10 have the cap 14 affixed thereto until the fluid dispenser 10 is used to dispense fluid, at which time the cap 14, or at least a portion thereof, is removed to provide access to the dome member 16. The cap 14 is configured to show evidence of tampering and, in at least some examples, once it is removed from the main body 12, it cannot be easily reattached.

The cap 14 has a tab 82, a body portion 84, and a bond strip 86. Extending from the body portion 84, the cap 14 comprises at least one ear 88. As illustrated in FIG. 12, for example, the cap 14 has two ears 88. The ears 88 snap-fit into the detents 72 (FIGS. 5 and 7) of the main body 12. Further, in some embodiments, the bond strip 86 is attached to a lip 92 (FIG. 5) of the main body 12. The bond strip 86 can be attached to the lip 92 in any desirable way, for example with adhesive or via ultrasonic welding. In some embodiments, the bond strip 86 has a plurality of teeth 94 (FIG. 12) which provide contact points to contact the lip 92. The teeth 94 are flattened during ultrasonic welding, for example, to yield a high strength bond between the bond strip 86 and the lip 92.

In some embodiments, the cap 14 has at least one tear strip 90. As shown in FIG. 1, for example, the cap 14 has two tear strips 90. In some examples, the tear strip(s) 90 extend entirely through the material of the body portion 84 along portion of length of the tear strip(s) 90. A shown in FIG. 11, for example, the tear strips 90 extend through the material near where the tab 82 adjoins the body portion 84. With regard to FIG. 12, as the tear strips 90 extend inwardly into the body portion 84 from the periphery of the cap 14, the tear strips 90 are thicker than nearer the periphery. Stated differently, the material thickness of the tear strips 90 increases along the length of the tear strip 90. The material thickness of the tear strips 90 is thinnest nearer the outer periphery of the cap 14. The thickness increases from the periphery until the tear strips 90 end at 96, where the material thickness of the tear strip(s) 90 is the same as the material thickness of the adjacent portion of the cap 14. Therefore, along a portion of the length of the tear strips 90, the tear strips 90 are reductions in the material thickness of the body portion 84.

Removal of the cap 14, for example by a user wishing to dispense fluid from the fluid dispenser 10, is carried out by pulling on the tab 82. As the tab 82 is pulled, the tear strips 90 begin to tear along their length and cracks propagate until the tear strips 90 end at 96. At this point, the ears 88 snap out of the detents 72 and the dome member 16 is partially exposed to the user. To remove the cap 14 entirely, such that the fluid dispenser 10 can be utilized, the user continues to pull on the tab 82, at which point the cap 14 fractures at the attachment columns 98 (FIG. 12). In this way, the bond strip 86 remains attached to the main body 12, and the body portion 84 and tab 82 of the cap 14 are removed from the bond strip 86 and are discarded.

With the cap 14 removed, the user can dispense fluid by depressing the dome member 16, as shown in FIG. 13, wherein the fluid dispenser 10 is in a flow configuration 104. In some examples, the dome member 16 elastically deforms to take on the second configuration 102 when it is depressed. The dome member 16 consequently moves the valve member 18 inwardly and sealing contact between the seal 32 and the sealing surface 78 of the valve member 18 is broken. As such, fluid is permitted to flow between the valve member 18 and the dividing wall 66 and out through the dispensing port 20. The fluid is further permitted to flow interiorly within the outer flow surface 106 and exteriorly to the inner flow surface 108 before exiting the fluid dispenser 10 via the dispensing port 20. A flow passage 124 (FIG. 13) extends from the cavity 30 and is at least partially bounded by the valve member 18 and main body 12 (e.g., outer flow surface 106, inner flow surface 108). In at least some embodiments, the flow passage 124 is a slanted passage, relative to the longitudinal axis 81 (FIG. 10), and at least a portion of the flow passage 124 extends 360 degrees around the stem 38.

Moreover, it will be appreciated that fluid is also permitted to flow past the guide 34, between the stem 38 and the guide 34, and into the chamber 68. Nonetheless, because the dome member 16 is sealed against the main body along recess 60, fluid is not permitted to exit the fluid dispenser 10 by any way other than through the dispensing port 20.

In order for the fluid to flow out of the fluid dispenser 10, it has to flow around the valve member 18. Due to the shape of the valve member 18, along with the guide 34 extending into the cavity 30, fluid must navigate a circuitous path. And, upon release of the dome member 16, the dome member 16 returns to its first configuration 100 (FIG. 2), the sealing surface 78 again comes into contact with the seal 32, and flow of fluid out of the dispensing port 20 ceases. Further, upon release of the dome member 16 and closure of the valve member 18, the fluid dispenser 10 can eliminate dripping.

Figure 14:
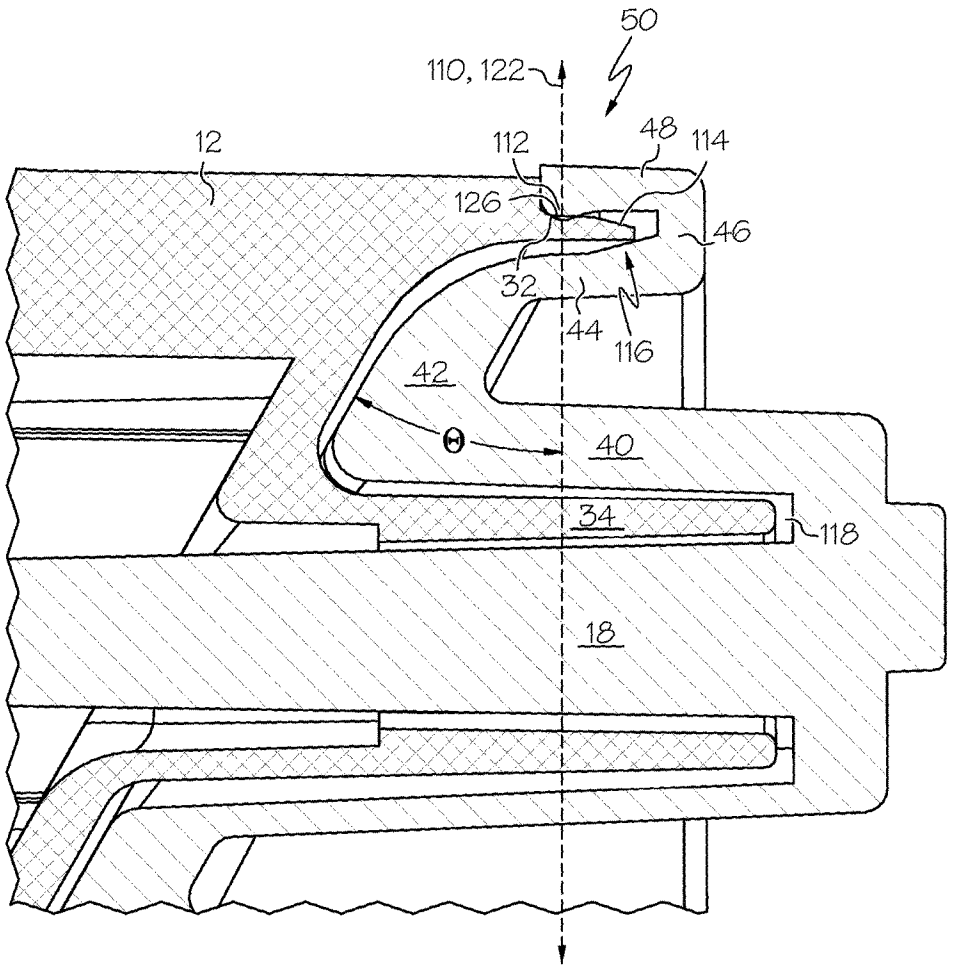
FIG. 14 shows a detailed cutaway view of the valve member and body of FIG. 13.

In some examples, flow of fluid out of the dispensing port 20 is reduced, however, upon release of the dome member 16 but prior to the sealing surface 78 sealing against seal 32. This is due in-part to the guide 34 extending a relatively long distance into the cavity 30. Further, because the inner tubular portion 40 overlaps a greater portion of the guide 34 at the bottom of the valve member 18 than at the top of the valve member 18, the flow of fluid around the valve member 18 is slowed prior to contact between the sealing surface 78 and the seal 32. And, in some embodiments, the face 80 is disposed at a non-zero angle, θ, relative to a sealing plane 110 (FIGS. 6, 14) such that fluid flow is reduced prior to contact between the sealing surface 78 and the seal 32. The sealing plane 110 is defined by a plane extending through the center of the contact surface 126 of the seal 32 such that at each location around the periphery of the seal 32, the center of the contact surface 126 lies on the sealing plane 110. The contact surface 126 is the surface of the seal 32 that mates with the sealing surface 78 when the fluid dispenser 10 is in the sealed configuration 50 (FIG. 14). In some embodiments, the non-zero angle θ is between 20 and 45 degrees. When the fluid dispenser 10 is in the sealed configuration 50, the sealing plane 110 and the valve seal plane 122 are coincident.

In at least some examples, when the fluid dispenser 10 is in the sealed configuration 50, there is no head pressure from the fluid within the container pushing outwardly on the dome member 16 because the sealing surface 78 and seal 32 are disposed between the dome member 16 and the fluid in the container. Additionally, head pressure from the fluid tends to aid in closing the fluid dispenser 10 by pushing the valve member 18 into the seal 32 of the main body 12.

With regard to FIG. 14, a detailed cross-sectional view of a portion of the valve member 18 is shown with a portion of the main body 12. As shown, the fluid dispenser 10 is in the sealed configuration 50.

In some examples, the outer tubular portion 48 has a lobe 112 (FIGS. 10 and 14) that contacts the seal 32. As the valve member 18 is closed, the lobe 112 moves toward the seal 32, ultimately sliding along incline 114 of the seal 32. Subsequently, the lobe 112 moves past the incline 114 until the valve member 18 comes to rest against the main body 12 such that the sealing surface 78 contacts the contact surface 126.

Additionally, in some examples, the outer tubular portion 48 pushes the seal 32 inwardly toward the intermediate tubular portion 44. In some embodiments, the intermediate tubular portion 44 comprises a wedge 116. As the lobe 112 pushes the seal inwardly toward the intermediate tubular portion 44, the wedge 116 comes into contact with the distal most end of the seal 32. The wedge 116 contacts on opposite side of the seal 32 than the lobe 112. This arrangement prevents creep and deformation of the seal 32 over time in order to ensure proper sealing of the fluid dispenser 10, even after a period of shelf time or use. The seal 32 is prevented from undergoing too much deformation because it is situated between the wedge 116 and lobe 112. Moreover, the lobe 112 and shape of the seal 32 and valve member 18 provide a relatively large area of contact between the seal 32 and valve member 18, thereby reducing the oxygen transmission rate of the fluid dispenser 10.

In some examples, when the fluid dispenser 10 is in the sealed configuration 50, as shown in FIG. 14, a capillary gap 118 is disposed between the valve member 18 and the guide 34. The presence of the capillary gap 118 eliminates post-closure dripping.

In some embodiments, the main body 12 is made of HDPE (high density polyethylene), although other materials are also suitable. Further, in some embodiments, the valve member 18 is made of HDPE, though other materials are also suitable. In some embodiments, the cap 14 is made of HDPE, though other materials are also suitable. The main body 12, valve member 18, and cap 14 can all be made from the same HDPE or different HDPEs, for example having different hardnesses.

In some examples, the dome member 16 is made of a TPE (thermoplastic elastomer), although other materials can also be used.

Where plastics are used, the various components (e.g., dome member 16, main body 12, valve member 18, cap 14) can be injection molded and assembled. At least some examples of the fluid dispenser 10 are assembled by inserting the valve member 18 into the main body 12 such that stem 38 extends through the guide 34 (FIG. 2). The valve member 18 can be inserted into the main body 12 until it bottoms against the main body 12. Then, the dome member 16 is added to the main body 12 by inserting the keeper 52 (FIG. 10) into the retainer 54 (FIG. 4). Also, the dome member 16 is seated against the recess 60 (FIG. 7). Subsequently, the cap 14 is added by placing the ears 88 (FIG. 11) within the detents 72 (FIG. 5); the bond strip 86 (FIG. 12) is pressed against the lip 92 (FIG. 5) and the two are ultrasonically welded together.

In at least some examples, even when the dome member 16 is in the first configuration 100 (FIG. 2), it continues to exert an outward (closing) force against the valve member 18. This helps to ensure sealing between the valve member 18 and the main body 12 as well as between the dome member 16 and the main body 12.

As will be appreciated, the coupler 24 can have any desired length or configuration. The coupler 24 can be configured to attach to a bag-in-box container, bag container, box container, or any other container with standardized or non-standardized shape.

Further, some embodiments of the fluid dispenser 10 can utilize dome members 16 formed of a clear material, for example to allow the color of the fluid to be seen. In some examples, the dome member 16 is made from a colored material which can also be used to signify the type or flavor of fluid.

In at least some examples of the fluid dispenser 10, at least a portion of the valve member 18 (e.g., intermediate tubular portion 44) extends over at least a portion of the dispensing port 20 prior to sealing of the valve member 20 against the seal 32. In this way, the flow of fluid can be throttled and/or reduced prior to closure of fluid dispenser 10.

U.S. Publication Nos. 2010/0296858 and 2013/0270305 and U.S. Pat. Nos. 8,459,510 and 8,690,026 are herein incorporated by reference.

Figure 15:
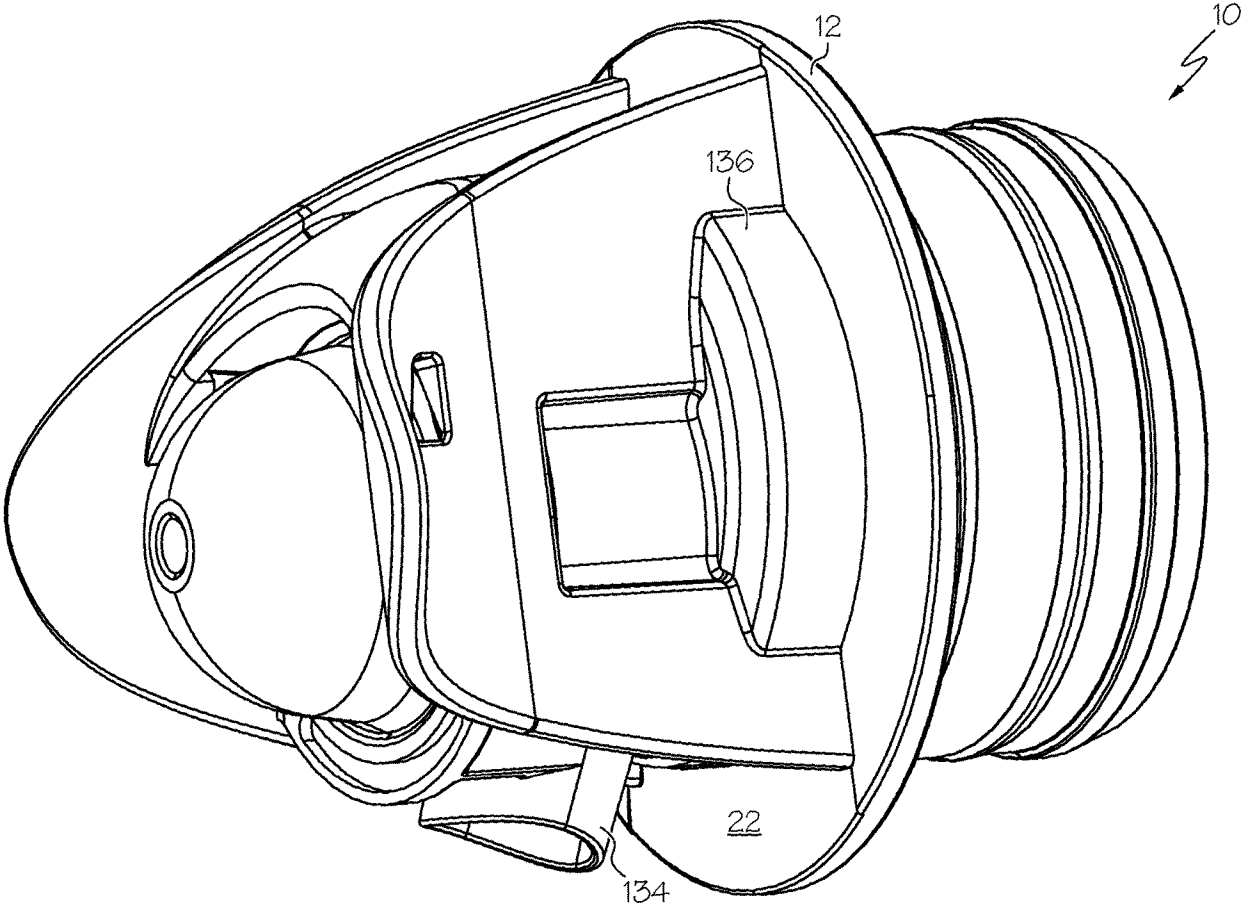
FIG. 15 shows a 3-dimensional view of an example of a fluid dispenser.
Figure 16:
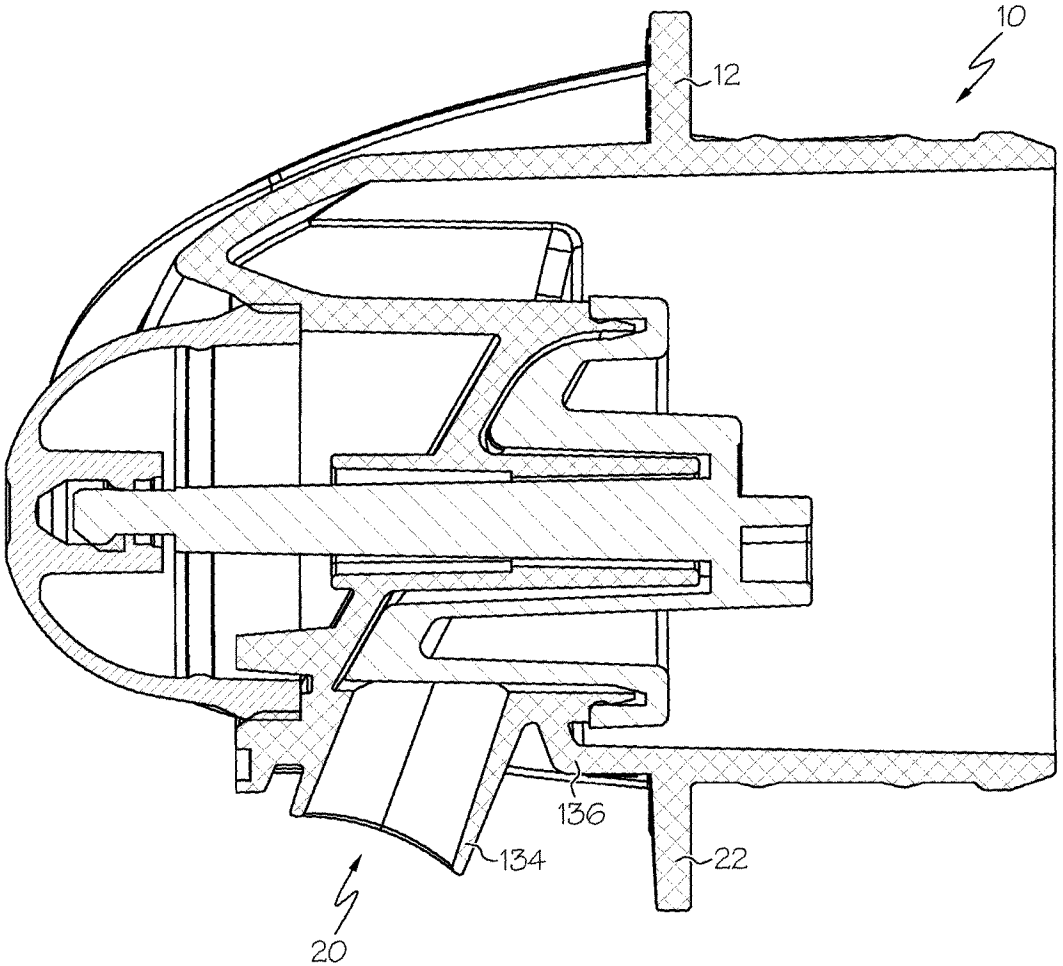
FIG. 16 shows a cutaway view of the fluid dispenser of FIG. 15.
Figure 17:
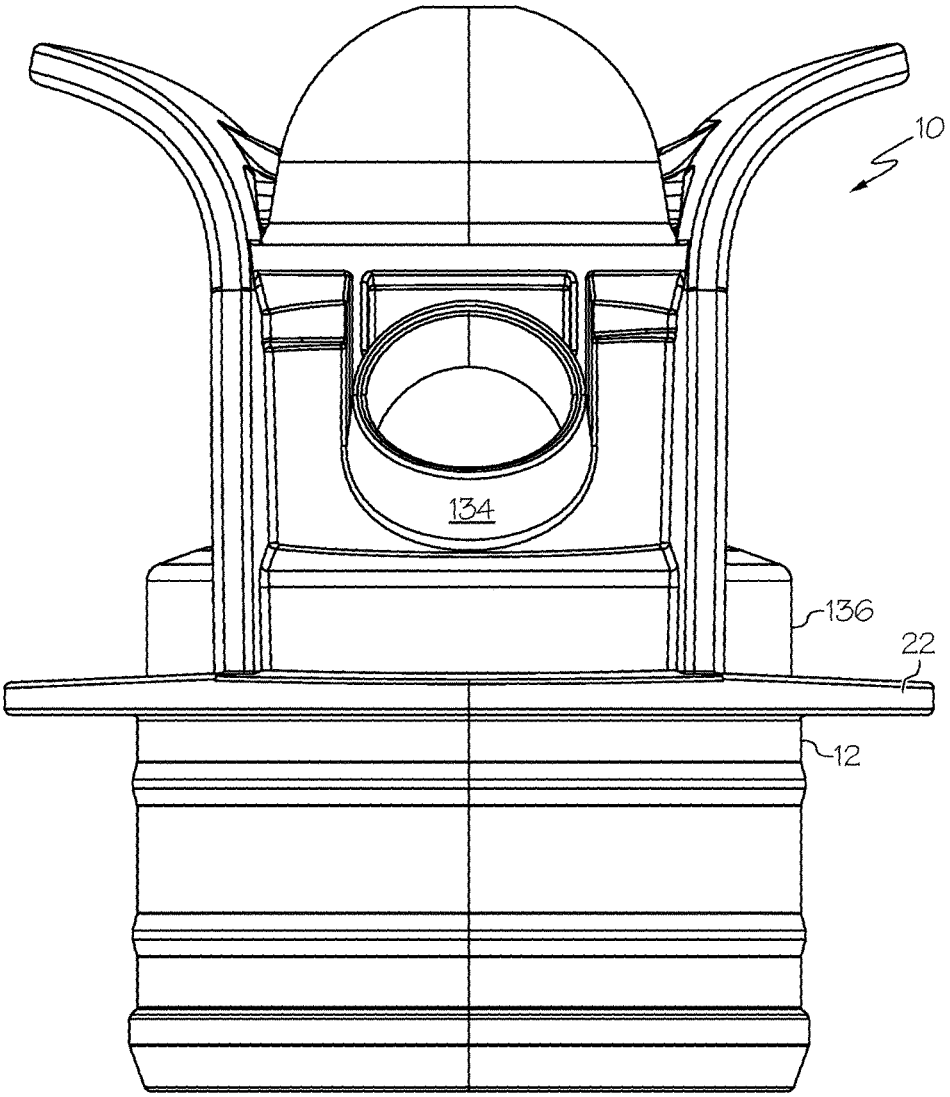
FIG. 17 shows a bottom view of the fluid dispenser of FIGS. 15 and 16.

FIGS. 15-17 show another example of a fluid dispenser 10. As shown, in some embodiments, the fluid dispenser 10 has a spout 134. In some embodiments, fluid is dispensed from the fluid dispenser 10 via the spout 134. In some embodiments, the spout 134 extends downwardly from the main body 12. Further, the spout 134 can extend away from the flange 22, permitting the user to position a rim of drinking vessel (e.g., glass or cup) between the flange 22 and the spout 134, thereby reducing the likelihood of spillage.

As further shown in FIGS. 15-17, in some embodiments, the body 12 comprises a barrel 136. In some embodiments, the barrel 136 extends from the flange 22 and provides a greater distance between flange 22 and the dispensing port 20, for example when compared to the embodiment shown in FIG. 2.

A description of some embodiments of the stents and the delivery catheter are contained in one or more of the following numbered statements:

Statement 1. A fluid dispenser having a flow configuration and a sealed configuration, the fluid dispenser comprising:
- a main body, the main body having an outer flow surface and an inner flow surface, the outer flow surface having an opening therethrough defining a dispensing port;
- a dome member; and
- a valve member, the valve member having a face and being coupled to the dome member;
- wherein, when the fluid dispenser is in the flow configuration, the outer flow surface, inner flow surface, and face define a fluid passageway for fluid to flow exteriorly to the inner flow surface, interiorly to the outer flow surface, and exit the fluid dispenser via the dispensing port.

Statement 2. The fluid dispenser of statement 1, wherein the valve member further comprises a stem, the stem being coupled to the dome member.

Statement 3. The fluid dispenser of statement 2, wherein the main body comprises a guide through which the stem extends.

Statement 4. The fluid dispenser of statement 3, wherein the guide comprises the inner flow surface.

Statement 5. The fluid dispenser of statement 1, wherein at least a portion of the outer flow surface is in opposing relationship with the inner flow surface.

Statement 6. The fluid dispenser of statement 1, wherein the main body has a seal and the valve member has an outer tubular portion, the outer tubular portion contacting the seal when the fluid dispenser is in the sealed configuration.

Statement 7. The fluid dispenser of statement 6, wherein the valve member has an intermediate tubular portion and the seal is disposed between the outer tubular portion and the intermediate tubular portion when the fluid dispenser is in the sealed configuration.

Statement 8. The fluid dispenser of statement 7, wherein the valve member comprises a wedge extending from the intermediate tubular portion, the wedge configured to contact a side of the seal opposite the outer tubular portion.

Statement 9. The fluid dispenser of statement 1, wherein the main body has a seal, the seal defining a sealing plane extending therethrough, the face angled with respect to the sealing plane at an angle between 20 and 45 degrees.

Statement 10. The fluid dispenser of statement 1, wherein the dome member is formed of an elastomeric material.

Statement 11. The fluid dispenser of statement 1, wherein the main body comprises a dividing wall, the face opposing the dividing wall.

Statement 12. The fluid dispenser of statement 1, wherein the main body has at least one stand-off member.

Statement 13. The fluid dispenser of statement 12, wherein the at least one stand-off member defines a recess.

Statement 14. The fluid dispenser of statement 13, wherein at least a portion of the dome member is seated against the recess.

Statement 15. The fluid dispenser of statement 1 further comprising a cap.

Statement 16. The fluid dispenser of statement 15, wherein the cap has at least one tear strip.

Statement 17. A fluid dispenser comprising:
- a main body having a sidewall with a first opening therein, and a seal;
- a valve member slidable within the main body, the valve member having an open position and a closed position, the valve member having a channel therein, the channel having a first sidewall and a second sidewall opposite the first sidewall, when the valve member is in the closed position, the seal extends into the channel and contacts the first and second sidewalls,
- the main body and valve member defining a second opening and flow passage therebetween, when the valve member is in the open position, the flow passage extending from the first opening to the second opening and when the valve portion is in the closed position, the flow passage being sealed by contact between the seal and at least the first sidewall.

Statement 18. The fluid dispenser of statement 17, wherein the second sidewall comprises a wedge extending into the channel.

Statement 19. The fluid dispenser of statement 17, wherein the first sidewall comprises a lobe.

Statement 20. A fluid dispenser comprising:
- a main body having a sidewall with an opening therein through which fluid can be dispensed;
- an elastomeric dome member; and
- a movable valve member, the valve member movable between a sealed position and an open position, the valve member having a stem which is coupled to the elastomeric dome member, the stem having a longitudinal axis,
- in the open position the main body and valve member defining a flow passage which ends at the opening,
- wherein the flow passage includes a section which extends 360 degrees about the stem and is bounded by the main body and the valve member, the flow passage being a slanted passage which slants relative to the longitudinal axis of the stem.

Statement 21. A fluid dispenser comprising:
- a main body having an opening therein through which fluid can be dispensed; and
- a movable valve member, the valve member movable between a sealed position and an open position,
- the valve member including:
  - a base portion,
  - a stem extending from the base portion,
  - a first portion extending from the base and extending all the way around at least a portion of the stem,
  - a first channel extending between the first portion and the stem, a second portion extending from the first portion, the second portion extending all the way around at least a portion of the stem, a third portion extending from the second portion, the third portion being annular and extending all the way around at least a portion of the stem, a second channel extending between the first, second, and third portions, a fourth portion extending outwardly from the third portion, the fourth portion being annular and extending all the way around at least a portion of the stem, a fifth portion extending from the fourth portion, the fifth portion being annular and extending all the way around at least a portion of the stem, a third channel extending between the third, fourth, and fifth portions, the main body including a first mating portion which, when the valve member is in the sealed position, extends into the third channel and contacts at least a portion of the fifth portion;

a flow passage being formed between the main body and the valve member when the valve member is in the open position, the flow passage terminating at the opening;

wherein the first and second channels are of decreasing depth as they extend about the stem away from the opening.

Statement 22. The fluid dispenser of statement 21, wherein the valve member is configured to mate with the main body such that in the open position, a fourth channel is defined between the second portion and the main body.

Statement 23. The fluid dispenser of statement 21, wherein the second channel faces an opposite direction than the first and third channels.

Statement 24. A fluid dispenser comprising:

a main body and a valve member, the main body having a seal, wherein one of the seal and valve member defines a channel and the other of the seal and valve member has a first surface and a second surface opposite the first surface, wherein when the fluid dispenser is in a closed configuration, the first and second surfaces contact opposing surfaces of the channel.

Statement 25. The fluid dispenser of statement 24, wherein the contact between the seal and valve member extends 360 degrees around the longitudinal axis of the valve member.

Statement 26. The fluid dispenser of statement 24 or statement 25, wherein the valve member can be any one of the valve members disclosed herein.

Statement 27. The fluid dispenser of any one of statements 24, 25, or 26, wherein the seal can be any one of the seals disclosed herein.

Statement 28. The fluid dispenser of any one of statements 24-27, wherein one of the opposing surfaces of the channel forms a wedge, for example as shown in FIG. 14 via reference numeral 116.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A fluid dispenser having a flow configuration and a sealed configuration, the fluid dispenser comprising:

a main body, the main body having an outer flow surface and an inner flow surface, the outer flow surface having an opening therethrough defining a dispensing port;

a dome member; and a valve member, the valve member having a face and being coupled to the dome member;

wherein, when the fluid dispenser is in the flow configuration, the outer flow surface, inner flow surface, and face define a fluid passageway for fluid to flow exteriorly to the inner flow surface, interiorly to the outer flow surface, and exit the fluid dispenser via the dispensing port, and further wherein the main body has a seal, the seal defining a sealing plane extending therethrough, the face angled with respect to the sealing plane at an angle between 20 and 45 degrees.

2. The fluid dispenser of claim 1, wherein the valve member further comprises a stem, the stem being coupled to the dome member.

3. The fluid dispenser of claim 2, wherein the main body comprises a guide through which the stem extends.

4. The fluid dispenser of claim 3, wherein the guide comprises the inner flow surface.

5. The fluid dispenser of claim 1, wherein at least a portion of the outer flow surface is in opposing relationship with the inner flow surface.

6. The fluid dispenser of claim 1, wherein the valve member has an outer tubular portion, the outer tubular portion contacting the seal when the fluid dispenser is in the sealed configuration.

7. The fluid dispenser of claim 6, wherein the valve member has an intermediate tubular portion and the seal is disposed between the outer tubular portion and the intermediate tubular portion when the fluid dispenser is in the sealed configuration.

8. The fluid dispenser of claim 7, wherein the valve member comprises a wedge extending from the intermediate tubular portion, the wedge configured to contact a side of the seal opposite the outer tubular portion.

9. The fluid dispenser of claim 1, wherein the dome member is formed of an elastomeric material.

10. The fluid dispenser of claim 1, wherein the main body comprises a dividing wall, the face opposing the dividing wall.

11. The fluid dispenser of claim 1, wherein the main body has at least one stand-off member.

12. The fluid dispenser of claim 11, wherein the at least one stand-off member defines a recess.

13. The fluid dispenser of claim 12, wherein at least a portion of the dome member is seated against the recess.

14. The fluid dispenser of claim 1 further comprising a cap.

15. The fluid dispenser of claim 14, wherein the cap has at least one tear strip.

16. A fluid dispenser comprising:

a main body having a sidewall with a first opening therein, and a seal;

a valve member slidable within the main body, the valve member having an open position and a closed position, the valve member having a channel therein, the channel having a first sidewall and a second sidewall opposite the first sidewall, when the valve member is in the closed position, the seal extends into the channel and contacts the first and second sidewalls, the main body and valve member defining a second opening and flow passage therebetween, when the valve member is in the open position, the flow passage extending from the first opening to the second opening and when the valve member is in the closed position, the flow passage being sealed by contact between the seal and at least the first sidewall, and wherein the seal defines a sealing plane extending therethrough, the face angled with respect to the sealing plane at an angle between 20 and 45 degrees.

17. The fluid dispenser of claim 16, wherein the second sidewall comprises a wedge extending into the channel.

18. The fluid dispenser of claim 16, wherein the first sidewall comprises a lobe.

19. A fluid dispenser comprising:

a main body having a sidewall with an opening therein through which fluid can be dispensed;

an elastomeric dome member; and a movable valve member, the valve member movable between a sealed position and an open position, the valve member having a stem which is coupled to the elastomeric dome member, the stem having a longitudinal axis, in the open position the main body and valve member defining a flow passage which ends at the opening, wherein the flow passage includes a section which extends 360 degrees about the stem and is bounded by the main body and the valve member, the flow passage being a slanted passage which slants relative to the longitudinal axis of the stem, and further wherein the main body has a seal, the seal defining a sealing plane extending therethrough, the face angled with respect to the sealing plane at an angle between 20 and 45 degrees.

* * * * *